US006457186B1

(12) United States Patent
Stewart

(10) Patent No.: US 6,457,186 B1
(45) Date of Patent: Oct. 1, 2002

(54) AIR CLEANING DEVICE FOR A TOILET BOWL

(75) Inventor: Dane Stewart, Houston, TX (US)

(73) Assignee: Streamline Ventures, Inc., Houston, TX (US)

( * ) Notice: Subject to any disclaimer, the term of this patent is extended or adjusted under 35 U.S.C. 154(b) by 0 days.

(21) Appl. No.: 09/772,357

(22) Filed: Jan. 30, 2001

(51) Int. Cl.[7] ..... E03D 9/04
(52) U.S. Cl. ..... 4/213; 4/209 R
(58) Field of Search ..... 4/209 R, 210, 4/211, 213, 216, 306, 347, 475, 477, 482

(56) References Cited

U.S. PATENT DOCUMENTS

| | | | | | |
|---|---|---|---|---|---|
| 1,894,846 | A | | 1/1933 | Bennett | |
| 2,009,054 | A | * | 7/1935 | Monney | 4/213 |
| 2,846,696 | A | * | 8/1958 | Herriott | 4/213 |
| 3,689,944 | A | | 9/1972 | Clayton | |
| 4,317,242 | A | | 3/1982 | Stamper | |
| 4,472,841 | A | * | 9/1984 | Faulkner | 4/213 |
| 5,403,548 | A | * | 4/1995 | Aibe et al. | 4/213 |
| 5,570,477 | A | | 11/1996 | Rodriquez | |
| 6,209,146 | B1 | * | 4/2001 | Gonzalez | 4/209 R |

FOREIGN PATENT DOCUMENTS

| | | | | |
|---|---|---|---|---|
| WO | WO 87/00879 | * | 2/1987 | 4/213 |

* cited by examiner

*Primary Examiner*—Gregory L. Huson
*Assistant Examiner*—Tuan Nguyen
(74) *Attorney, Agent, or Firm*—Timothy M. Donoughue; Winstead Sechrest & Minick P.C.

(57) ABSTRACT

An air cleaning device of the type for deodorizing and/or masking odor from a toilet is provided. The air cleaning device comprises a housing having a cleaning section, the housing connectable to a toilet bowl with the housing being positioned within the toilet bowl; a motor and fan functionally positioned within the housing; a cleaning element positioned approximate the fan within the housing; and at least one switch electrically connecting the fan motor to a power source for operationally controlling the motor. When the motor is activated, air within the toilet is drawn through the housing and across the cleaning element, exhausting the air within the toilet bowl.

30 Claims, 1 Drawing Sheet

AIR CLEANING DEVICE FOR A TOILET BOWL

TECHNICAL FIELD

The present invention relates in general to devices for cleaning air and in particular to an air cleaning device for treating air in a toilet bowl so as to eliminate or mask a foul odor.

BACKGROUND

Numerous devices and methods have been devised over the years to address offensive odors which tend to emanate from toilet bowls. Some of the devices and methods consist of placement of a deodorizing element adjacent to a toilet bowl or spraying a deodorizing mist and/or disinfectant adjacent the toilet bowl. Some of these prior art devices vent the offending air out of the toilet bowl and through a wall to an area exterior of the restroom. Some of the devices draw the offending air from the interior of the toilet bowl, filter it through an odor adsorbent medium, such as activated charcoal, and exhaust the air directly into the room containing the toilet bowl.

Many of these devices require specially designed toilet bowls and/or modifications to the structures adjacent the toilet, special toilet seats or modified tanks, toilet bowls having built in vent lines, vent holes cut through walls, or special piping, and electrical wiring. These permanent type air cleaning devices are expensive and are typically difficult to maintain.

Some aftermarket air cleaning devices require extensive installation and connection to sewer vent lines. Other known temporary devices, while easily connected to toilet bowls, exhaust the deodorized air from the toilet into the restroom. Although these devices may deodorize the air in the toilet bowl, they emit the residual odor, bacteria and contaminants into the environment adjacent the toilet.

It would be a benefit, therefore, to have an air cleaning device that is easily connectable to a toilet bowl. It would be a further benefit to have an air cleaning device that reduces the odor of the air in a toilet and exhausts the cleaner air within the toilet bowl. It would be a still further benefit to have an air cleaning device for a toilet bowl that is inexpensive and easily maintained. It would be a still further benefit to have an air cleaning device for a toilet bowl that automatically and temporarily operates when the toilet bowl is in use.

GENERAL DESCRIPTION

The present invention provides an air cleaning device for a toilet bowl that is easily connectable to a toilet bowl. The present invention provides an air cleaning device for a toilet bowl that reduces the odor of a portion of air and exhausts the cleaner air within the toilet bowl. The invention further provides an air cleaning device for a toilet bowl that automatically and temporarily operates when the toilet bowl is in use. The present invention also provides an air cleaning device for a toilet bowl that is inexpensive and easily maintained.

Accordingly, an air cleaning device of the type for deodorizing and/or masking odor from a toilet is provided. The air cleaning device comprises a housing having a cleaning section, the housing connectable to a toilet bowl and being positioned within the toilet bowl; a motor and fan functionally positioned within the housing; a cleaning element positioned approximate the fan within the housing; and at least one switch electrically connecting the fan motor to a power source for operationally controlling the motor. When the motor is activated air within the toilet is drawn through the housing and across the cleaning element exhausting the air within the toilet bowl.

The cleaning element may include a deodorizing agent and/or masking agent. Deodorizing agents may include filters such as activated charcoal filters and the like. Masking agents may consist primarily of perfumed materials. Deodorizing agents and masking agents may be used singularly or in combination.

Several types of switches may be used to activate the air cleaning device, including but not limited to manual switches, pressure activated switches, motion detection switches and other electronic or mechanical switches. Different types of switches may be used singularly or in combination with other switches to accommodate various needs. The switches may include timing devices.

DETAILED DESCRIPTION

Figure 1:
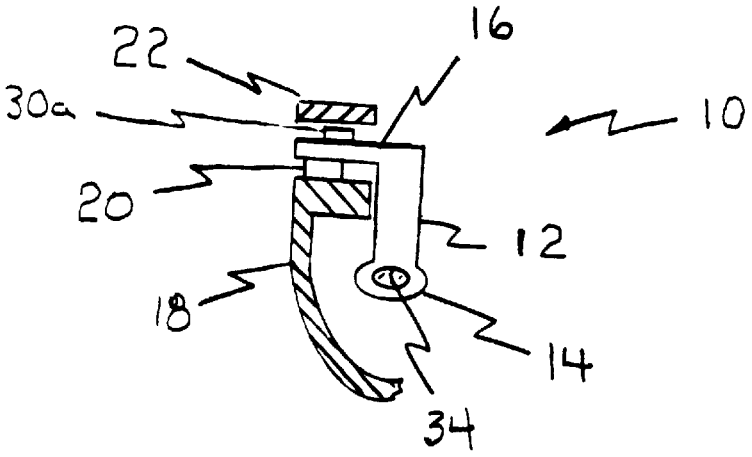
FIG. 1 is a side view of the air cleaning device for a toilet bowl of the present invention.

Refer now to the drawings wherein depicted elements are not necessarily shown to scale and wherein like or similar elements are designated by the same reference numeral through the several views.

FIG. 1 is a side view of an air cleaning device for a toilet bowl of the present invention generally designated by the numeral 10. The air cleaning device 10 comprises a housing 12 having a cleaning section 14 and an attachment arm 16.

The housing 12 is constructed of a water resistant material such as a hard plastic. In one embodiment, the housing 12 may be opened to change filters or batteries shown in FIG. 2. The extension arm 16 is adapted for connecting to a rim of a toilet bowl 18 so that the cleaning section 14 is disposed within the toilet bowl 18. As shown, the extension arm 16 may be connected to the toilet bowl 18 below the toilet seat 22 by a connecting mechanism 20 such as, but not limited to, an adhesive tape. The connecting mechanism 20 may comprise a bracket (not shown). It is desirable to have a connection mechanism 20 that allows for removal of the air cleaning device 10 for maintenance or relocation.

Figure 2:
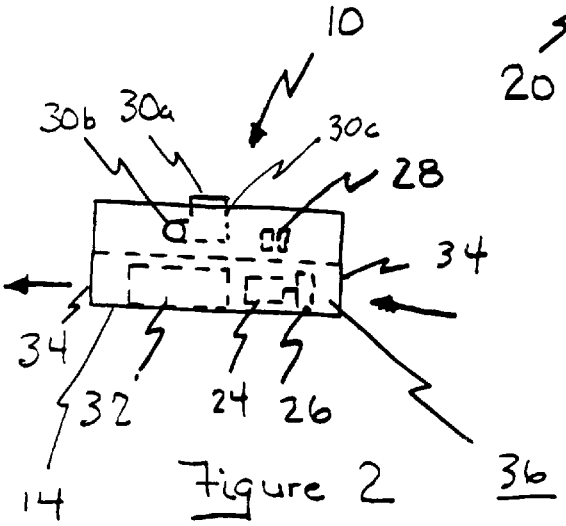
FIG. 2 is an end view of the air cleaning device for a toilet bowl of the present invention

FIG. 2 is an end view of the air cleaning device for a toilet bowl 10 of the present invention. Located within the air cleaning device 10 is a fan motor 24 connected to a fan 26. The fan motor 24 is electrically connected to a power source 28. The power source 28 is preferably a direct current device such as a battery. The power source 28 is operationally connected to the fan motor 24 via at least one switch 30. As shown in FIG. 2, a pressure-sensitive microswitch 30*a* and/or a motion detection switch 30*b* are provided. Either the microswitch 30*a* or the motion detection switch 30*b* may be equipped with a timer circuit 30*c* for delayed starting and/or stopping of the fan motor 24. The air cleaning device 10 may include an on-off switch, pressure-switch or motion detection switch, singularly or in combination. It is desirable to have a switch 30 that operates the fan motor 24 automatically when needed and shuts off when the toilet bowl 18 is not in use.

As shown by the hidden lines, the fan motor 24 and the fan 26 are disposed within a channel 36 formed within cleaning section 14. A deodorizing element 32 is also disposed within channel 36. The deodorizing element 32 may be any element suitable for deodorizing or masking foul air such as, but not limited to, activated carbon or a perfumed material. The deodorizing element 32 may include a combination of elements to deodorize, mask, and/or disinfect the air stream.

Vents 34 are formed through the cleaning section 14 on opposite sides of the fan 34. The deodorizing element 32 may draw air from the toilet bowl 18 through air cleaning device 10 and exhaust the cleaned air back into the toilet bowl 18. As shown in FIG. 2, the vents 34 are located on the ends of the cleaning section 14, however those skilled in the art will appreciate that the vents 34 may be located on the bottom of the cleaning section 14.

Figure 3:
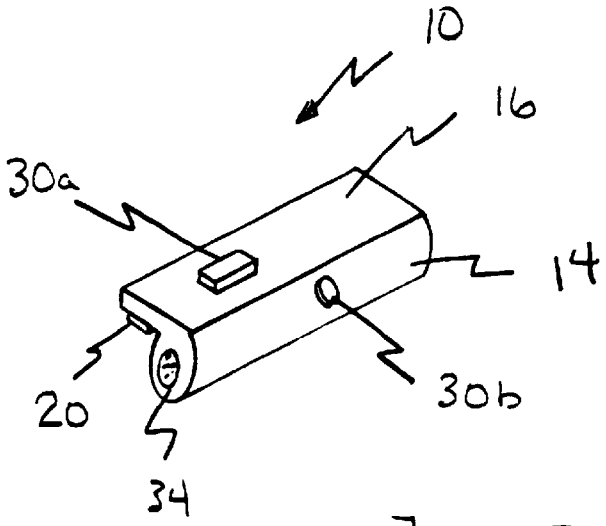
FIG. 3 is a perspective view of the air cleaning device for a toilet bowl of the present invention.

FIG. 3 is a perspective view of the air cleaning device for the toilet bowl 10 of the present invention. Although, the connecting arm 16 is shown as rectangular, it should be recognized that the arm 16 may be structured and sized in many different ways to allow connection of the cleaning device 10 to the toilet bowl 18, including an extension arm (not shown) to hang on the rim of the toilet bowl 18. With additional reference to FIG. 1, pressure switch 30*a* may be positioned in the connecting arm 16 so as to operate cleaning device 10 when pressure is placed on a toilet seat 22. The motion detector switch 30*b* may be connected through a portion of the cleaning section 14 of the cleaning device 10. The motion detector switch 30*b* may be oriented so as to activate when movement is detected above the toilet bowl 18 or in the toilet bowl 18.

Use of the air cleaning device 10 of the present invention is described with reference to FIGS. 1 through 3. The air cleaning device 10 has a substantially L-shaped housing 12 comprising the connecting arm 16 and the depending cleaning section 14. The connecting arm 16 is connected to a portion of the toilet bowl 18 by the connecting mechanism 20. The connecting mechanism 20 may be an adhesive tape, clamp, or a varying configuration of the connecting arm 16 so as to attach to the toilet bowl 18. The cleaning device 10 is connected to the toilet 18 so that the cleaning section 14 is disposed within the toilet bowl 18.

The cleaning device 10 is activated by the switch 30 electrically connecting the power source 28 to the fan motor 32. The power source 18 is preferably a direct current source but may be an alternating current source, provided the appropriate safety features are also provided. The switch 30 may be a simple on-off switch such as a toggle switch (not shown), and/or the pressure-sensitive switch 30*a*, and/or the motion detector switch 30*b*. When a user enters the restroom, the cleaning device 10 may be activated, singularly or in combination, by manually turning the device 10 on, sitting on the toilet seat 22, or creating movement adjacent to the toilet bowl 18. Once activated, the cleaning device 10 draws air from the toilet bowl through the conduit 36 and across the deodorizing element 32. The deodorizing element 32 may be a deodorizer, such as activated charcoal or a masking agent. Once the air has passed by or through deodorizing element 32, the air is exhausted back into the toilet bowl 18. Essentially, the cleaning device 10 circulates and cleans the air in the toilet 18 without directly exhausting the air into the atmosphere adjacent to the toilet bowl 18.

Although the present invention and its advantages have been described in detail, it should be understood that these enabling embodiments are illustrative and the optimum relationships for the parts of the invention may include various changes, substitutions and alterations can be made herein without departing from the spirit and scope of the invention as defined by the appended claims all of which are readily apparent to one of ordinary skill in the art. For example, various physical changes and dimensions may be modified to match particular toilets, particularly with regard to the mechanisms and configurations to securely fasten the cleaning device to the toilet the type of switch 30 employed, and the various forms of deodorizing and/or masking agents which may be utilized. It is not desired to limit the invention to the exact construction shown, and al suitable modifications and equivalents may be resorted to, all falling within the scope of the invention described.

What is claimed is:

1. An air cleaning device comprising:

a housing, said housing connectable to a toilet bowl and being positioned within said toilet bowl;

a motor and fan functionally positioned within said housing so as to vent into said toilet bowl;

a cleaning element positioned proximate to said fan within said housing; and at least one switch electrically connecting said motor to a power source for operationally controlling said motor.

2. The air cleaning device of claim 1 wherein, when said motor is activated air within said toilet, air is drawn through said housing and across said cleaning element, exhausting said air within said toilet bowl.

3. The air cleaning device of claim 2 wherein said switch comprises a pressure-sensitive switch.

4. The air cleaning device of claim 2 wherein said switch comprises a motion detection switch.

5. The air cleaning device of claim 2 wherein said switch comprises a pressure-sensitive switch and a motion detection switch.

6. The air cleaning device of claim 2 wherein said switch comprises a timer.

7. The air cleaning device of claim 1 wherein said cleaning element comprises a deodorizer.

8. The air cleaning device of claim 7 wherein said switch comprises a pressure-sensitive switch.

9. The air cleaning device of claim 7 wherein said switch comprises a motion detection switch.

10. The air cleaning device of claim 7 wherein said switch comprises a pressure-sensitive switch and a motion detection switch.

11. The air cleaning device of claim 7 wherein said switch comprises a timer.

12. The air cleaning device of claim 1 wherein said cleaning element comprises a masking agent.

13. The air cleaning device of claim 12 wherein said switch comprises a pressure-sensitive switch.

14. The air cleaning device of claim 12 wherein said switch comprises a motion detection switch.

15. The air cleaning device of claim 12 wherein said switch comprises a pressure-sensitive switch and a motion detection switch.

16. The air cleaning device of claim 12 wherein said switch comprises a timer.

17. The air cleaning device of claim 1 wherein said cleaning element comprises a member of the group consisting essentially of deodorizer and a masking agent.

18. The air cleaning device of claim 17 wherein said switch comprises its pressure-sensitive switch.

19. The air cleaning device of claim 17 wherein said switch comprises a motion detection switch.

20. The air cleaning device of claim 17 wherein said switch comprises a pressure-sensitive switch and a motion detection switch.

21. The air cleaning device of claim 17 wherein said switch comprises a timer.

22. The air cleaning device of claim 1 wherein said switch comprises a pressure-sensitive switch.

23. The air cleaning device of claim 1 wherein said switch comprises a motion detection switch.

24. The air cleaning device of claim 1 wherein said switch comprises a pressure-sensitive switch and a motion detection switch.

25. The air cleaning device of claim 1 wherein said switch comprises a timer.

26. A cleaning device comprising:

a housing having a cleaning section, and an arm, said housing connectable to a toilet bowl with said cleaning section being positioned within said toilet bowl and said arm attached to said toilet bowl;

a motor and fan functionally positioned within said cleaning section venting into said toilet bowl;

a cleaning element including a deodorizing element positioned proximate to said fan within said cleaning section; and a pressure switch within said arm electrically connecting said fan motor to a power source for operationally controlling said motor.

27. The cleaning device of claim 26 wherein, when said motor is activated, air within said toilet is drawn through said housing and across said cleaning element exhausting said air within said toilet bowl.

28. The cleaning device of claim 27 wherein said pressure switch further comprises a timer.

29. The cleaning device of claim 26 wherein said cleaning element further comprises a masking agent.

30. The cleaning device of claim 26 wherein said pressure switch further comprises a timer circuit.

* * * * *